US006145484A

United States Patent [19]

Funakoshi et al.

[11] Patent Number: 6,145,484

[45] Date of Patent: Nov. 14, 2000

[54] FOUR-CYCLE ENGINE HAVING IMPROVED LUBRICATING MECHANISM

[75] Inventors: Hirokazu Funakoshi; Kazuaki Aizawa; Kenji Imafuku, all of Hamura, Japan

[73] Assignee: Shin-Daiwa Kogyo Co., Ltd., Hiroshima, Japan

[21] Appl. No.: 09/145,650

[22] Filed: Sep. 2, 1998

[30] Foreign Application Priority Data

| | | | |
|---|---|---|---|
| Sep. 2, 1997 | [JP] | Japan | 9-237399 |
| Feb. 6, 1998 | [JP] | Japan | 10-026084 |
| Feb. 6, 1998 | [JP] | Japan | 10-026241 |

[51] Int. Cl.[7] ..... F02B 75/02; F02B 33/04

[52] U.S. Cl. ..... 123/73 AD; 123/196 CP; 123/196 M; 123/317; 123/318

[58] Field of Search ..... 123/73 AD, 311, 123/317, 318, 196 M, 196 R, 196 W, 196 CP; 184/6.5, 6.14, 6.18, 6.8

[56] References Cited

U.S. PATENT DOCUMENTS

| | | | |
|---|---|---|---|
| 4,461,251 | 7/1984 | Sheaffer | 123/317 |
| 4,475,499 | 10/1984 | Sheaffer | 123/317 |
| 4,558,671 | 12/1985 | Stinebaugh | 123/317 |
| 4,813,391 | 3/1989 | Geyer et al. | 123/73 C |
| 5,230,314 | 7/1993 | Kawahara et al. | 123/317 |
| 5,347,967 | 9/1994 | Todero et al. | 123/317 |
| 5,377,634 | 1/1995 | Taue | 123/317 |
| 5,558,057 | 9/1996 | Everts | 123/195 R |
| 5,657,724 | 8/1997 | Brown et al. | 123/73 R |
| 5,678,525 | 10/1997 | Taue | 123/73 A |
| 5,701,855 | 12/1997 | Kurihara et al. | 123/73 AD |
| 5,778,833 | 7/1998 | Kuranishi | 123/52.4 |
| 5,778,838 | 7/1998 | Taue | 123/73 B |
| 5,873,332 | 3/1999 | Taue et al. | 123/52.4 |
| 5,950,590 | 9/1999 | Everts et al. | 123/196 R |
| 5,960,770 | 10/1999 | Taue et al. | 123/317 |
| 5,992,375 | 11/1999 | Nagashima | 123/317 |
| 6,055,959 | 5/2000 | Taue | 123/317 |

FOREIGN PATENT DOCUMENTS

| | | | |
|---|---|---|---|
| 6-108864 | 4/1994 | Japan . | |
| 0662392A5 | 9/1987 | Switzerland | 123/317 |
| 2254884A | 10/1992 | United Kingdom | 123/317 |
| 2263307A | 7/1993 | United Kingdom | 123/317 |

*Primary Examiner*—Tony M. Argenbright
*Assistant Examiner*—Hai Huynh
*Attorney, Agent, or Firm*—Liniak, Berenato, Longacre & White

[57] ABSTRACT

A four-cycle engine in which a mixed gas of a fuel and air containing a lubricating oil is transferred from a carburetor to a cylinder or a crank chamber, the gas is pushed out in the stage of descending the piston to the passage on the reverse side, transferred into a rocker arm chamber including an intake valve at the top of the cylinder via a passage including a valve gear mechanism, and it is directed to the cylinder in the intake stage, whereby the engine is lubricated by the lubricating oil. The engine has no oil pan and can be run at any inclination angle (360°). Also disclosed is that it is also possible for the four-cycle engine to provide a diverged second passage extending to the crank room, to provide a lead valve on a portion of the second the passage, to provide a diverged third passage extending to the lower end of the crank chamber, to provide a lead valve or rotary valve, and to provide a fourth and/or fifth passage(s) to circulate the mixed gas.

6 Claims, 11 Drawing Sheets

FOUR-CYCLE ENGINE HAVING IMPROVED LUBRICATING MECHANISM

FIELD OF THE INVENTION

1. Field of the Invention

The present invention relates to an improvement of lubricating mechanism for a small-sized four-cycle engine to be used, for example, in a bush cutter, comprising mixing a lubricating oil with a fuel to be supplied to the engine as a mixed fuel, making it possible to bring about the lubrication without an oil pan.

2. Prior Art

Most of the conventional engines for a bush cutter are two-cycle engines, and they utilize a mixed fuel composed a lubricant, a fuel, and air. The reason why such a two-cycle engine has hitherto been used in such an application is that the two-cycle engine for a bush cutter which possesses no oil pan can be operated even if it is tilted in any degree (360°).

However, although the two cycle engine is of advantageous in that it can lubricate a cylinder and a piston by a lubricating oil contained in the fuel, a part of the mixed gas composed of the fuel, the lubricating oil and air is inhaled in the cylinder due to an insufficient exhaust, exhausting the inhaled mixed gas in the state of incomplete combustion. Consequently, harmful components contained in the exhaust gas have an adverse influence upon the environment. For this reason, the existing two-cycle engine can not pass the legal regulation and, thus, is for fear of the limitation of using the two-cycle engine.

In recent years, in order to substitute the two-cycle engine, a four-cycle engine which can be operated at any inclination angle (360°) has been developed. In such an engine, for example, a lubricating oil is misted in an oil tank provided on the side of the crank chamber by means of an oil slinger to circulate the lubricating oil in every nook and corners and, at the same time, a returning pore which can put back the lubricating oil into the oil tank in every inclination states, a return and oil-supplying pore for a lubricating oil is provided on the center of the oil tank so that the bush cutter can be run in very inclination states.

On the other hand, as the further advanced four-cycle engine, a four-cycle engine which utilizes a mixed gas comprising a lubricating oil, a fuel, and air, and which provide no oil pan, have been developed. For example, Japanese Patent Laid-Open Publication No. 6-108,864 discloses a four-cycle supercharging engine in which a volume change in the crank chamber according to the reciprocating movement of the piston to supercharge the mixed gas into the cylinder. In this engine, a passage communicating a carburetor with an intake port, which is opened or closed by an intake valve, is provided, a bypass passage communicating a carburetor with a crank chamber is also provided, an intake valve which only allows the intake of the mixed gas into the crank room is provided at the position where the bypass passage is connected to the crank chamber, a supercharging passage communicating the crank chamber with the inside of the cylinder is provided, an outlet port is provided at the position where it is opened when the piston descends to the portion near the bottom dead point, and a supercharging valve which is opened when the piston descends to the portion near the bottom dead point is provided via the supercharging passage.

However, the conventional engines have the disadvantages that they are composed of many parts, have complicated structures, and have high manufacturing costs, and there is need for improving the lubricating mechanism.

SUMMARY OF THE INVENTION

An object of the present invention is, therefore, to provide a four-cycle engine which can run in every inclination states (360°), which is composed of a relatively few parts, which has a relatively simple structure, which has good lubricating mechanism, and which has a small manufacturing cost.

The first aspect of the present invention, which attains the object just mentioned, relates to a four-cycle engine providing an intake valve, an exhaust valve, and an ignition plug on the top of a cylinder, and supplying a mixed gas composed of a fuel and air, which comprises:

an inlet for the mixed gas perforated on a cylinder wall so that a mixed gas composed of the fuel and air and also previously containing a lubricating oil is supplied to the cylinder, said inlet being provided at a portion of the cylinder wall where it is opened at a portion near the top dead point of the piston, and it is closed by the piston in the ascending or descending stages other than the above-mentioned state;

a passage for the mixed gas provided so that the mixed gas containing the lubricating oil, which is pushed to the crank chamber in the stage of descending the piston, is pushed out of an outlet of the mixed gas perforated on the crank chamber or the cylinder wall, said mixed gas then passes through a passage including a valve gear mechanism provided outside of the crank chamber or the cylinder wall, and said mixed gas is transferred to the intake valve placed at the top of the cylinder; and a lead valve provided between the inlet of the mixed gas and the outlet of the passage communicating with the carburetor so that the mixed gas never flows back to the carburetor side.

According to the second aspect of the present invention, there is provided a four-cycle engine providing an intake valve, an exhaust valve, and an ignition plug on the top of a cylinder, and supplying a mixed gas composed of a fuel and air, which comprises:

an inlet for the mixed gas perforated on a cylinder wall so that a mixed gas composed of the fuel and air and also previously containing a lubricating oil is supplied to the cylinder, a passage for the mixed gas provided so that the mixed gas containing the lubricating oil, pushed to the crank chamber in the stage of descending the piston, which is pushed out of an outlet of the mixed gas perforated on the crank chamber or the cylinder wall, said mixed gas passes through a passage including a valve gear mechanism provided outside of the crank chamber or the cylinder wall, and said mixed gas is transferred to the intake valve placed at the top of the cylinder; and a rotary valve provided within the crank chamber in the passage communicating with the carburetor so that the mixed gas never flows back to the carburetor side.

According to the third aspect of the present invention, there is provided a four-cycle engine providing an intake valve, an exhaust valve, and an ignition plug on the top of a cylinder, and supplying a mixed gas composed of a fuel and air, which comprises:

a second passage for the mixed gas diverged from the lower surface of a first passage extending from the carburetor to the intake valve so that the mixed gas composed of the lubricating oil, the fuel, and air enters the cylinder via the inlet on the cylinder wall communicating with the second passage, is compressed in the stage of descending the piston to be pushed out from the passage provided on the wall of the crank chamber, said mixed gas then passes through the passage including the valve gear mechanism provided outside of the cylinder wall, and said mixed gas flows toward the intake valve at the top of the cylinder; and a lead valve provided on a portion of the diverged second passage for the mixed gas composed of the lubricating oil, the fuel, and air.

According to the fourth aspect of the present invention, there is provided a four-cycle engine providing an intake valve, an exhaust valve, and an ignition plug on the top of a cylinder, and supplying a mixed gas composed of a fuel and air, which comprises:

a third passage for the mixed gas diverged from the lower surface of a first passage extending from the carburetor to the intake valve so that the mixed gas composed of the lubricating oil, the fuel, and air enters the crank chamber via the inlet of the crank chamber, said mixed gas is compressed in the stage of descending the piston to be pushed out from the passage provided on the wall of the crank chamber, said mixed gas then passes through the passage including the valve gear mechanism provided outside of the cylinder wall, and said mixed gas flows toward the intake valve at the top of the cylinder; and a lead valve or a rotary valve provided on a portion of the diverged second passage for the mixed gas composed of the lubricating oil, the fuel, and air.

According to the fifth aspect of the present invention, there is provided a four-cycle engine providing an intake valve, an exhaust valve, and an ignition plug on the top of a cylinder, and supplying a mixed gas composed of a fuel and air, which comprises:

a first passage for supplying a mixed gas composed of the lubricating oil, the fuel, and air from the carburetor to the intake valve, a second passage for supplying the mixed gas, and a third passage for supplying the mixed gas each diverged from the lower surface of the first passage so that the mixed gas passes through the second and the third passages to be transferred to the crank chamber, said mixed gas then passes through the passage including the valve gear mechanism provided outside of the cylinder wall, and said mixed gas flows toward the intake valve at the top of the cylinder; and a check valve provided so that a part of the mixed gas can be returned to the valve gear mechanism to fully lubricate the parts of the crank mechanism and those of the valve gear mechanism residing on the lower side, which are highly required for the lubricating.

According to the sixth aspect of the present invention, there is provided a four-cycle engine providing an intake valve, an exhaust valve, and an ignition plug on the top of a cylinder, and supplying a mixed gas composed of a fuel and air, which comprises:

a first passage for supplying a mixed gas composed of the lubricating oil, the fuel, and air from the carburetor to the intake valve, a second passage for supplying the mixed gas, and a third passage for supplying the mixed gas each diverged from the lower surface of the first passage so that the mixed gas passes through the second and the third passages to be transferred to the crank chamber, said mixed gas passes through the passage including the valve gear mechanism provided outside of the cylinder wall, and said mixed gas flows toward the intake valve at the top of the cylinder; and a fourth passage as a fourth bypass which returns a part of the mixed gas to the first passage, and/or a fifth passage as a fifth bypass which returns a part of the mixed gas to a portion between an air cleaner and the carburetor, further to the first passage, at which the mixed gas is mixed with a fresh, mixed gas whereby efficiency for inhaling the mixed gas is further improved.

In the first to the fourth aspect of the present invention, a supply pump is provided so that a desired amount of the lubricating oil is supplied to the passage communicating the carburetor with the inlet perforated on the cylinder wall or on the crank chamber.

Also, in the first to the fourth aspect of the present invention, a manual pump for supplying a desired amount of the fuel to the intake valve at the start of the engine may be provided.

DESCRIPTION OF THE PREFERRED EMBODIMENTS

The present invention will now be described by referring to the accompanying drawings.

Figure 1:
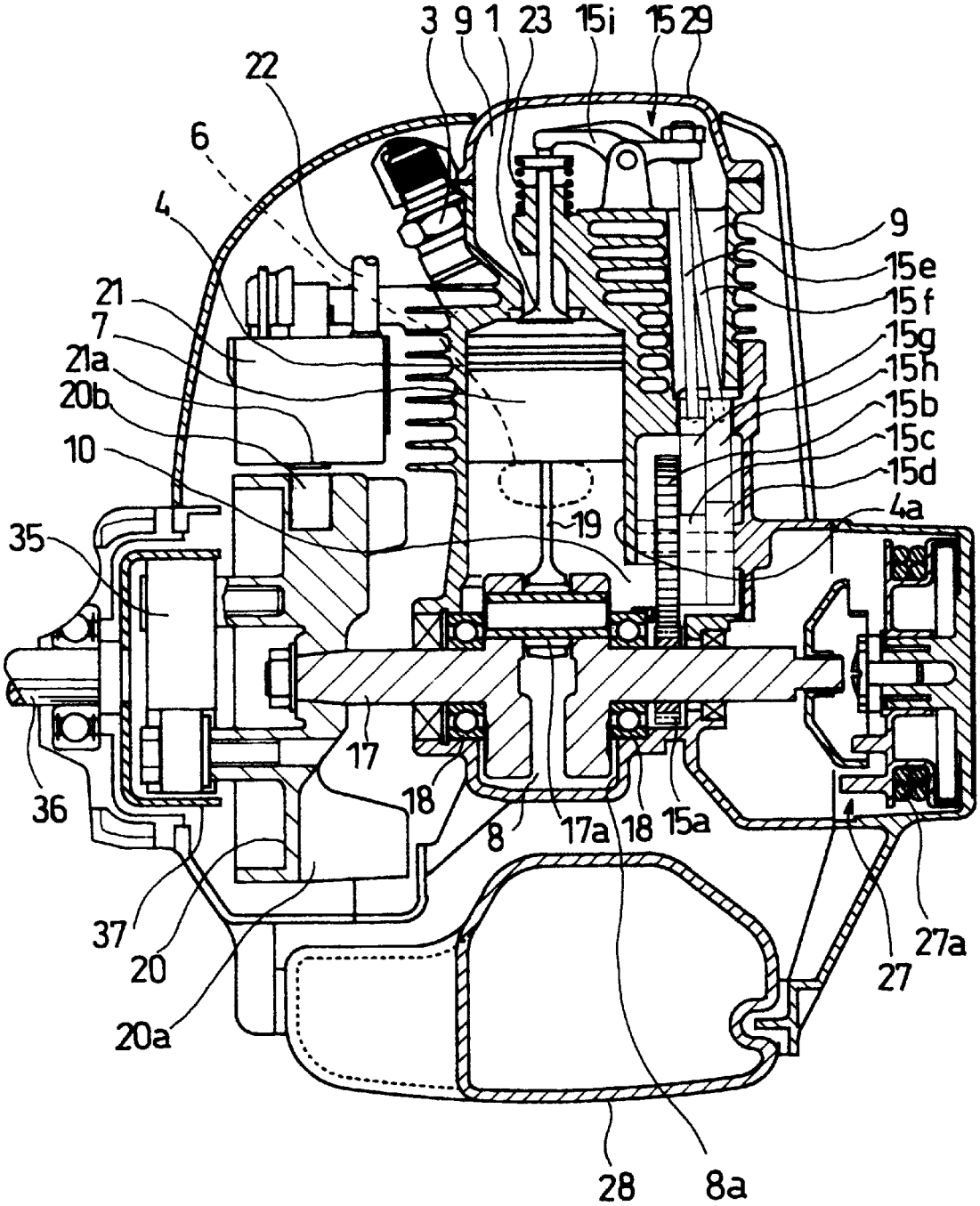
FIG. 1 is a cross-sectional view showing a four-cycle engine according to one embodiment of the present invention.
Figure 2:
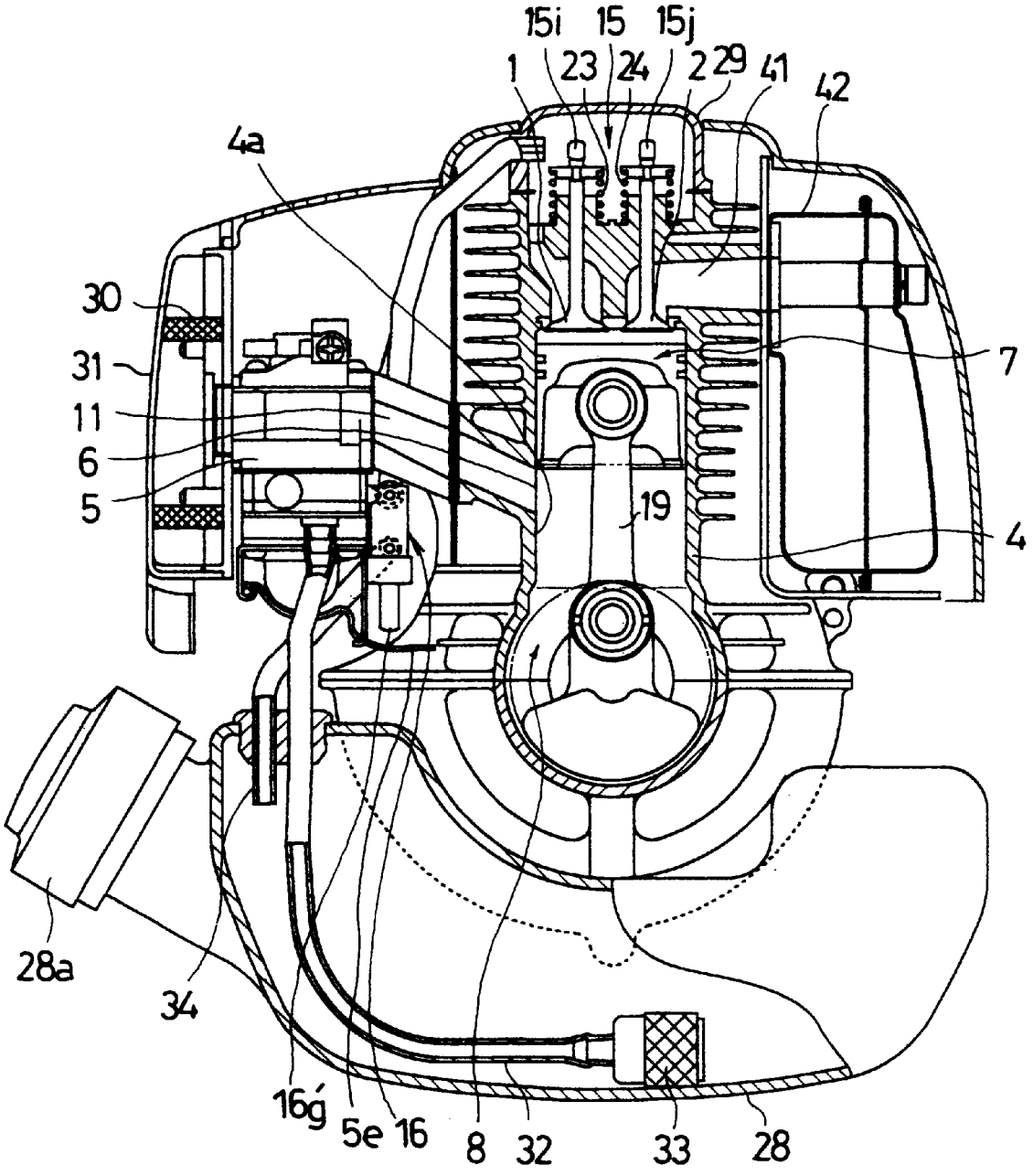
FIG. 2 is a cross-sectional view of the four-cycle engine of FIG. 1 shown in the direction rotating the four-cycle engine of FIG. 1 at 90°, while it stands up straight, the figure also showing a mixed gas inlet perforated on the cylinder wall.

FIG. 1 is a cross-sectional view of the four-cycle engine according to one embodiment of the present invention, and FIG. 2 is a cross-sectional view of the four-cycle engine of FIG. 1 shown in the direction rotating the four-cycle engine of FIG. 1 at 90°, while it stands up straight, the figure also showing a mixed gas inlet perforated on the cylinder wall.

In FIG. 1, numerical 17 represents a crankshaft, and numerical 18 represents a bearing. The crankshaft 17 is projected out of the crank chamber 8 via the bearing 18. A crank pin 17*a* and a piston 7 are connected by means of a connecting rod 19. A rotor 20 is provided at a left side of the crankshaft 17. A cooling fan 20*a* is provided on the rotor 20*b,* and a permanent magnet 20 is provided on a part of the circumference of the rotor 20. Numerical 21 represents an ignition coil, and 21*a* represents a core for the ignition coil 21. A high voltage is brought about at every approach and passage of the permanent magnet 20*b* to the core 21*a,* and the voltage is applied on an ignition plug 3 via a high voltage code 22. Numerical 35 is a centrifugal clutch shoe provided on the rotor 20. A clutch drum 37 provided at the end of a rotation output shaft 36 is intervened between the outer circumference of the centrifugal clutch shoe 35. When the engine runs at a rotation number exceeding a prescribed level, the centrifugal clutch shoe 35 is brought into contact with the clutch drum 35 by means of a centrifugal force to transmit the rotating force of the crankshaft 17 to the rotation output shaft 36.

In FIG. 1, a gear 15*a* for moving a valve gear mechanism 15 which opens or closes an intake valve 1 and an exhaust valve 2 (see FIG. 2) is provided at a right side of the crankshaft 17. A reduction gear 15*b* is provided so as to be engaged with the gear 15*a*. Cams 15*c* and 15*d,* which revolve together with the reduction gear 15*b,* are provided, and push rods 15*e* and 15*f* are connected to these cams 15*c* and 15*d,* respectively. Cam lifters 15*g* and 15*h* are placed on the base ends of the push rods 15*e* and 15*f*. To the front ends of the push rods 15*e* and 15*f* are connected to each one end of rocker arms 15*i* and 15*j* (see FIG. 2). The other ends of the rocker arms 15*i* and 15*j* are pushed down against springs 23 and 24 to alternatively open the intake valve 1 and the exhaust valve 2. The parts making up the valve gear mechanism are provided in the mixed gas passage 9 provided so as to communicate the outlet 10 for the mixed gas perforated on the wall 8*a* of the crank chamber with the intake valve 1 through the outside of the cylinder wall 4*a*. On a right side of the crankshaft 17 is provided a recoil starter 27, which rotates the crankshaft 17 by pulling a starter rope 27*a* at starting the engine.

In FIG. 2, numerical 28 presents a fuel tank, 28*a* represents a cap of the fuel tank, 29 represents a cover for covering the valve gear mechanism 15, 30 represents an air cleaner, 31 represents a cover for the air cleaner, 32 represents a fuel pipe, 33 represents a filter having a weight, and 34 represents an overflow pipe. One end of the fuel pipe 32 is connected to the filter 33 having a weight and is incorporated in the fuel tank 28. The other end of the fuel pipe 32 is connected to the carburetor 5. In the four-cycle engine making up of the parts described above, when a fuel having been premixed with a desired amount of a lubricating oil is incorporated in the fuel tank 28 to be used, the mixed gas composed of the fuel and air having been mixed with the lubricating oil is supplied from the carburetor 5 to the cylinder 4 and to the crank chamber 8 through the mixed gas inlet 6 perforated on the cylinder wall 4*a* at a portion near the top dead point of the piston 7.

To be specific, in FIG. 2, an inlet 6 for a mixed gas for supplying a mixed gas of a fuel and air from a carburetor 5 to a cylinder 4 is perforated on a cylinder wall 4*a*. The inlet 6 for the mixed gas (only the position shown as a dot line in FIG. 1) is provided on a position such that the inlet is opened when the position of a piston 7 is near the top dead point and is closed by the piston in the stage of moving the piston 7, except for the piston residing near the top dead point. Between a crank chamber 8 and an intake valve 1, a passage 9 for the mixed gas of the fuel and air is provided so as to communicate an inlet 10 of the mixed gas (only shown in FIG. 1) perforated on the wall 8*a* of the crank chamber to the intake valve 1 via outside of the cylinder wall 4*a*.

When the piston 7 is moved from a portion near the top dead point to the bottom dead point, the mixed gas inlet 6 is closed by means of the piston 7 and, at the same time, the mixed gas containing the lubricating gas which is supplied to the cylinder 4 and to the crank chamber 6 is compressed by the piston 7 as shown in FIG. 1, whereby it is pushed out to the mixed gas passage 9 (shown in FIG. 1) which communicates the crank chamber 8 with the intake valve 1. When the intake valve 1 is opened, the mixed gas is compressed to be transferred to the combustion chamber through the intake valve 1. The mixed gas is then compressed in a compression stage by the piston 7, and ignited and exploded by the ignition plug. Thereafter, when the piston 7 is moved from the bottom dead point to the top dead point in the exhaust stage, the mixed gas is exhausted from the exhaust valve 2. Thereafter, these actions are repeated. In these actions, a part of the lubricating oil contained in the mixed gas is adhered to the valve gear mechanism 15, the cylinder 4 and the piston 7, and then combusted, there is no need for recovering the lubricating oil. Consequently, there is no need for providing any oil pan, the engine can be run, even if it is tilted in any direction (360°). In FIG. 2, numerical 16 represents a manual pump which supplies a desired amount of the lubricating oil at starting the four-cycle engine for bush cutter according to the present invention. Also, 16*g*' represents a knob for the manual pump, and 5*e* is a lever for pushing up the knob 16*g*'. The function of the manual pump will be described in the column concerning the description of FIG. 11.

Figure 3:
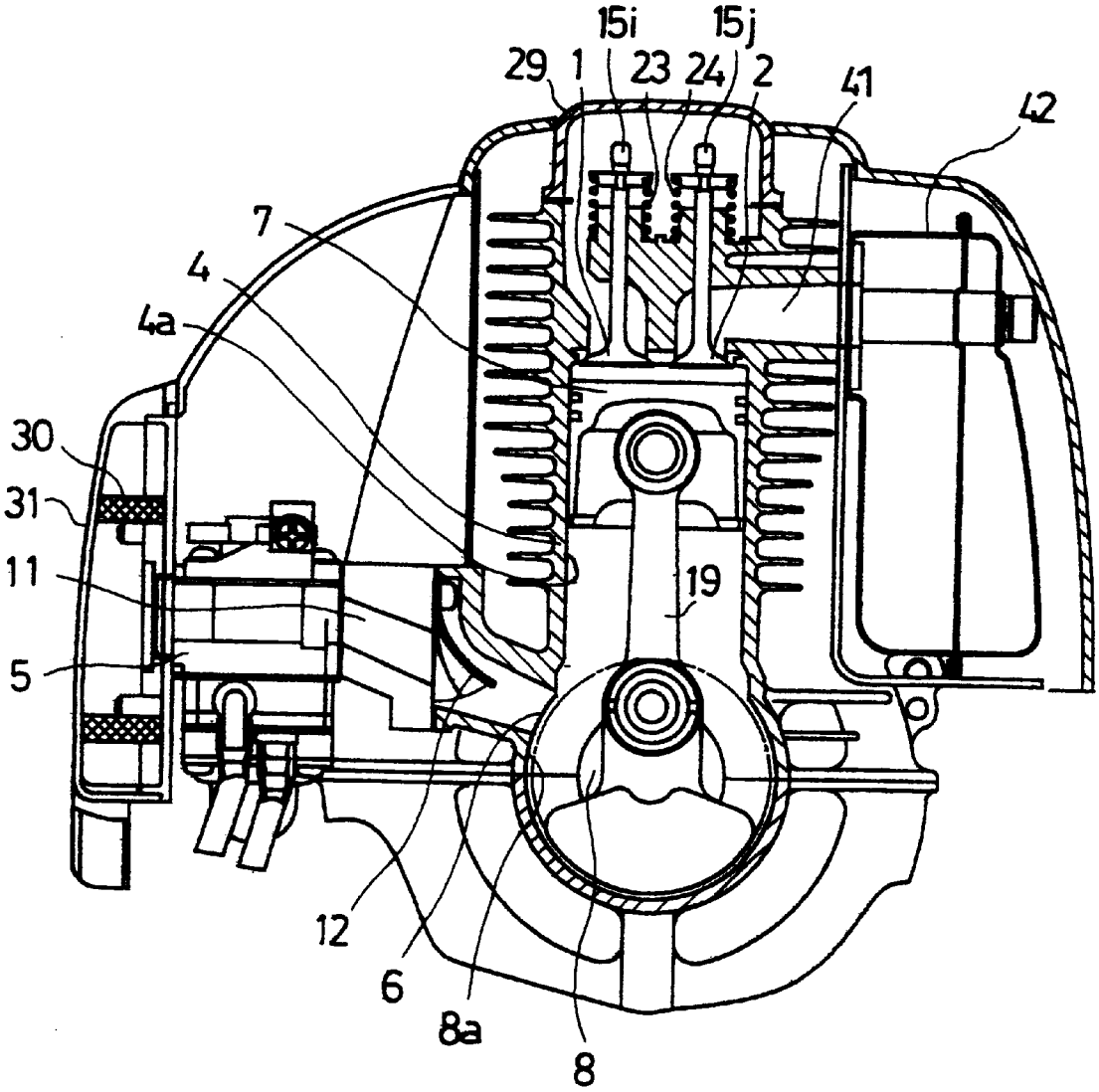
FIG. 3 is a cross-section view of the four-cycle engine according to another embodiment of the present invention in which the position of a mixed gas inlet is modified so as to be perforated on the wall of the crank chamber, in this embodiment, a lead valve being provided on the mixed gas passage.

FIG. 3 is a cross-sectional view of the four-cycle engine according to another embodiment of the present invention. A mixed gas inlet 6 is perforated on the wall 8*a* of the crank chamber so that the mixed gas composed of the fuel and air is supplied from the carburetor to the crank chamber 8, and a lead valve 12, which is opened in the stage of ascending the piston and which is closed in the stage of descending the piston, is provided on a mixed gas passage 11. The lead valve 12 supplies the mixed gas into the cylinder 4 and the crank chamber 8 in the ascending stage of the piston 7, while the lead valve 12 is closed in the descending stage of the piston 7 so as to prevent the mixed gas from being flown into the carburetor as countercurrent.

Figure 4:
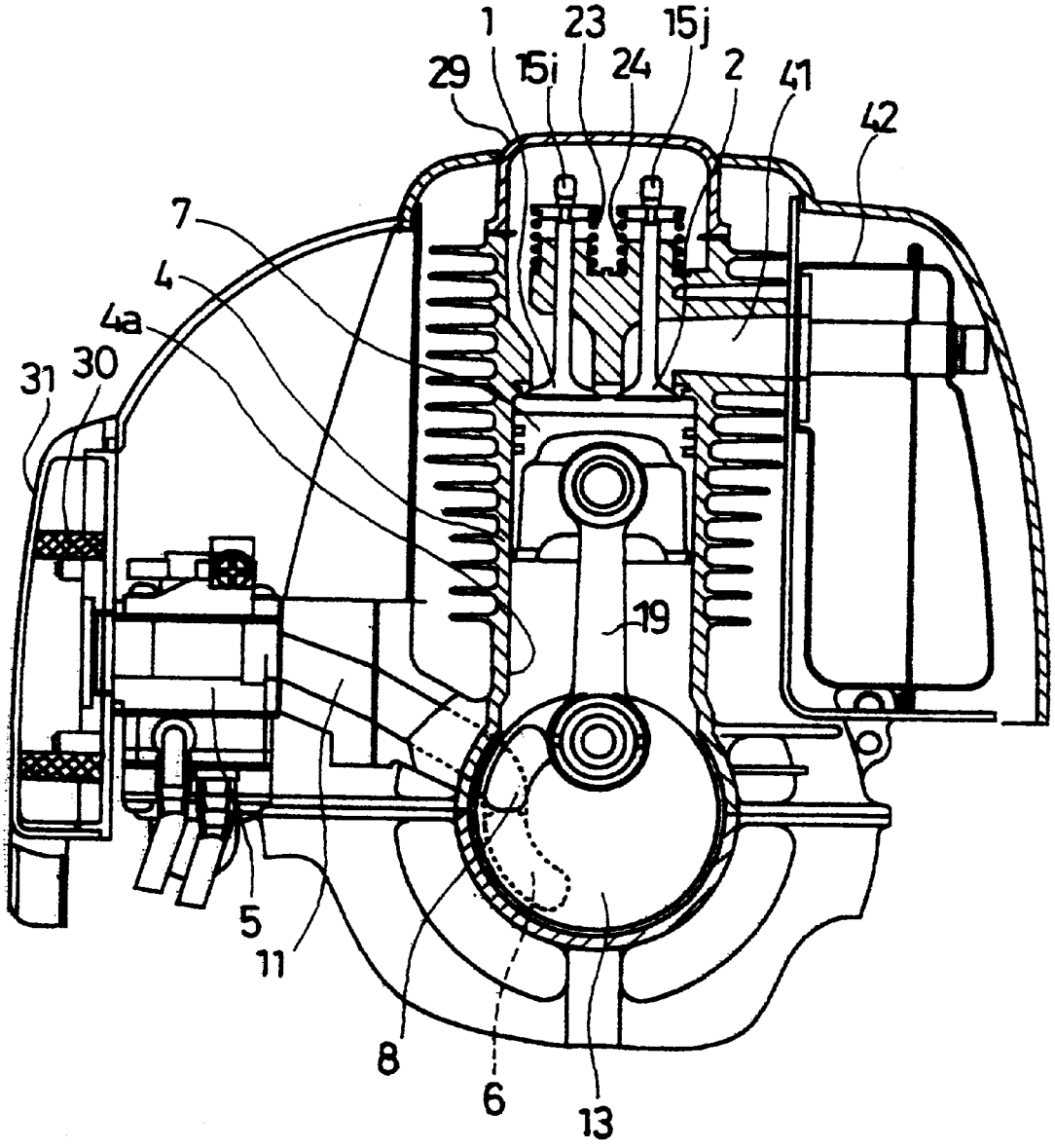
FIG. 4 is a cross-section view of the four-cycle engine according to still another embodiment of the present invention in which a rotary valve is provided on the crank chamber instead of the lead valve in FIG. 3.

FIG. 4 shows a variation in which a rotary valve 13 is provided within the crank room in place of the lead valve in FIG. 3. The rotary valve 13 supplies the mixed gas to the cylinder 4 and the crank chamber 8 in the ascending stage of the piston 7, while the rotary valve 13 is closed in the descending stage of the piston 7 so as to prevent the mixed gas from being flown back to the carburetor.

Figure 5:
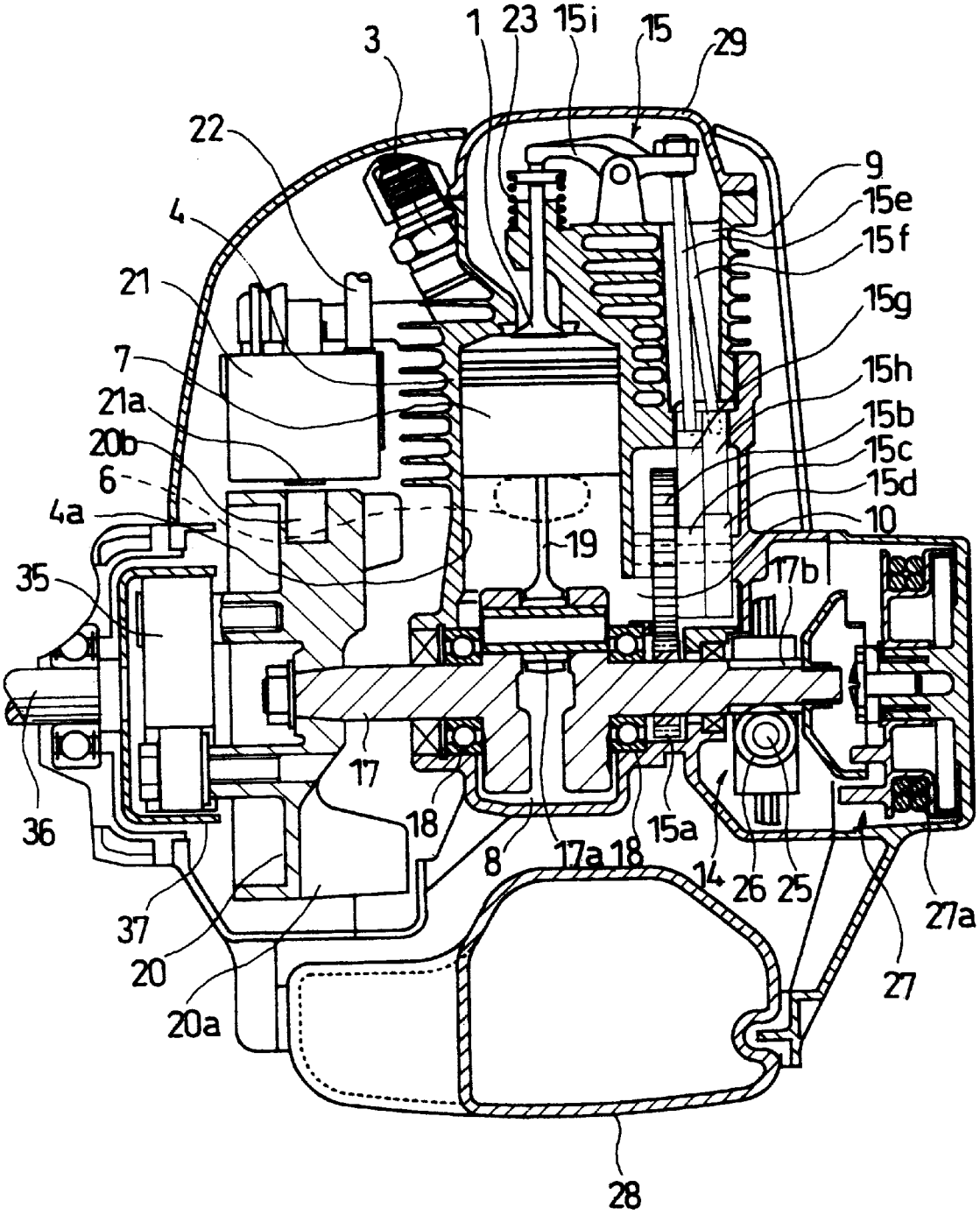
FIG. 5 is an explanatory view showing a position of a pump for supplying a desired amount of the lubricating oil to the mixed gas passage, which pump is communicated with the crankshaft.

FIG. 5 is a cross-sectional view showing an embodiment that a supply pump 14 for supplying a desired amount of the lubricating oil 14 is provided on a passage 11 (see FIGS. 2, 3, and 4) which communicated a carburetor 5 with a mixed gas inlet 6 perforated on a cylinder wall 4*a*. On the supplying pump 14 is formed a worm gear 17 at a right end of the crankshaft 17 shown in the figure. A gear 26 having a driving shaft 25 of the supply pump 14 for supplying the lubricating oil provided therein is engaged with the worm gear 17*b*. The supply pump 14 for supplying the lubricating oil supplies the lubricating oil from, f or example, a lubricating tank installed together with the fuel tank, to the mixed gas passage 11 via the supply pump for the lubricating oil (not shown).

Figure 6:
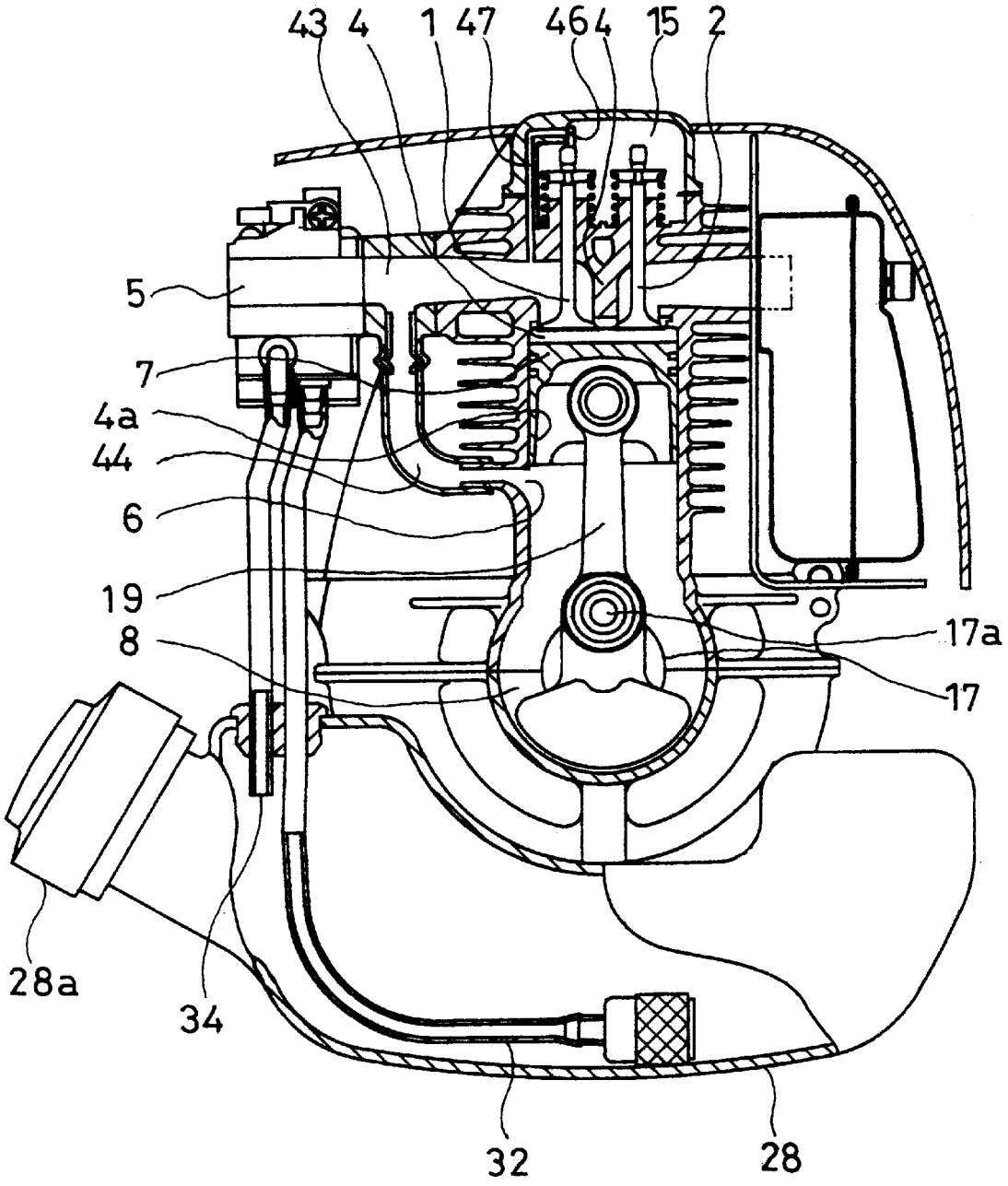
FIG. 6 is an explanatory view showing a first passage which supplies the mixed gas to a rocker arm chamber, and a second passage diverged from the lower surface of the first passage, which supplies the mixed gas containing the lubricating oil to the cylinder and the crank chamber.

In an embodiment shown in FIG. 6, a first passage 43 for supplying the mixed gas composed of the fuel, air, and the lubricating oil from the carburetor 5 toward the intake valve 1 is provided. An open hole 6 is placed on a cylinder wall 4*a* at a such a position that it is opened when the piston 7 within the cylinder 4 is at a portion near the top dead point, and it is closed, when the piston is in the moving stage except for the portion near the top dead point. A second passage 44 is provided at the portion between the open hole 6 and the position diverged from the first passage 43.

The mixed gas composed of the fuel, air, and the lubricating oil passes through the passage 44, is transferred to the cylinder, and then to the crank chamber. The mixed gas composed of the fuel, air, and the lubricating oil is compressed in the crank chamber 8 when the piston 7 is descended. The mixed gas then passes through a bearing 18 which supports the crankshaft 17, through the outlet 10 (see FIG. 5) perforated on the wall of the crank chamber, and through the valve gear mechanism 15 (see FIG. 5) which opens or closes the intake valve and the exhaust valve, and is transferred to the rocker arm chamber. Although being not specifically shown in FIG. 5, it is, of course, possible to provide a lead valve at the outlet 10 on the wall of the crank chamber to secure the intake and compressive transmission of the mixed gas.

Only the intake valve is opened, the mixed gas enters a fourth passage 47 as a bypass via a switching valve 46, and then is returned to the first passage 43.

Figure 7:
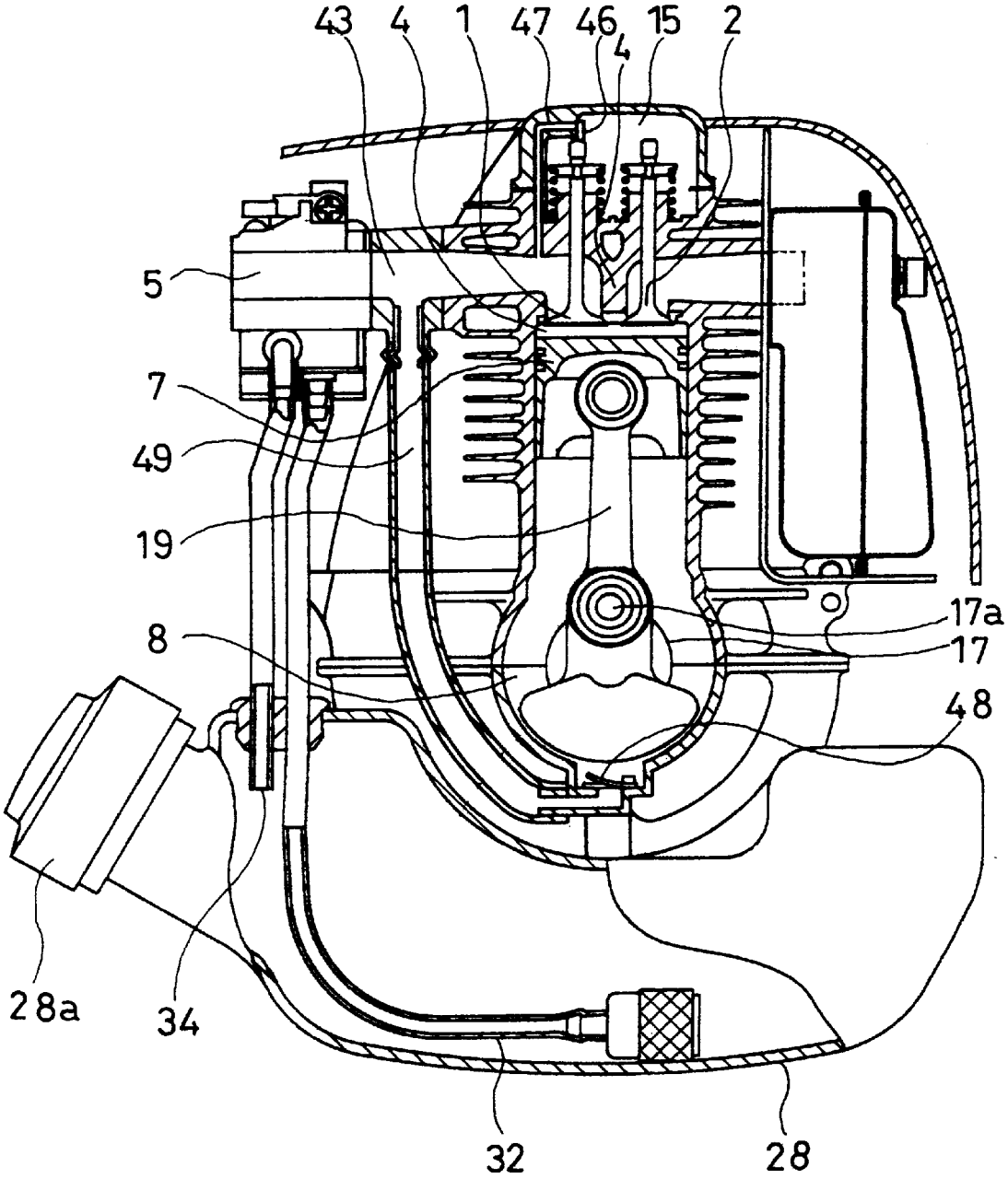
FIG. 7 is an explanatory view showing another embodiment of the present invention in which third and fourth passages for supplying the mixed gas containing the lubricating oil to the crank chamber are provided in place of the second passage of FIG. 6.

In an embodiment as shown in FIG. 7, in addition to the first passage for supplying the mixed gas composed of the fuel, air, and the lubricating oil from the carburetor 5 to the intake valve, a third passage 49 which communicates the open hole at the lower end of the crank chamber 8 is provided, a lead valve 48 which is opened in the stage of ascending the piston and is closed in the stage of descending the piston is provided at a lower portion of the crank chamber. In this embodiment, the mixed gas composed of the fuel, the lubricating oil, and air passes through the third passage 49 and transferred to the crank chamber. The mixed gas then passes though the outlet 10 perforated on the wall of the crank chamber, and through the valve gear mechanism 15 which opens or closes the intake valve and the exhaust valve, and is transferred to the rocker arm chamber. Further, the mixed gas from the rocker arm chamber enters a fourth passage 47 as a bypass via a switching valve 46, only in the case where the intake valve 1 is opened, to be returned to the first passage 43. Although being not specifically shown in FIG. 7, it is needless to say that a rotary valve as shown in FIG. 4 can be provided within the crank chamber in place of the lead valve 48.

Figure 8:
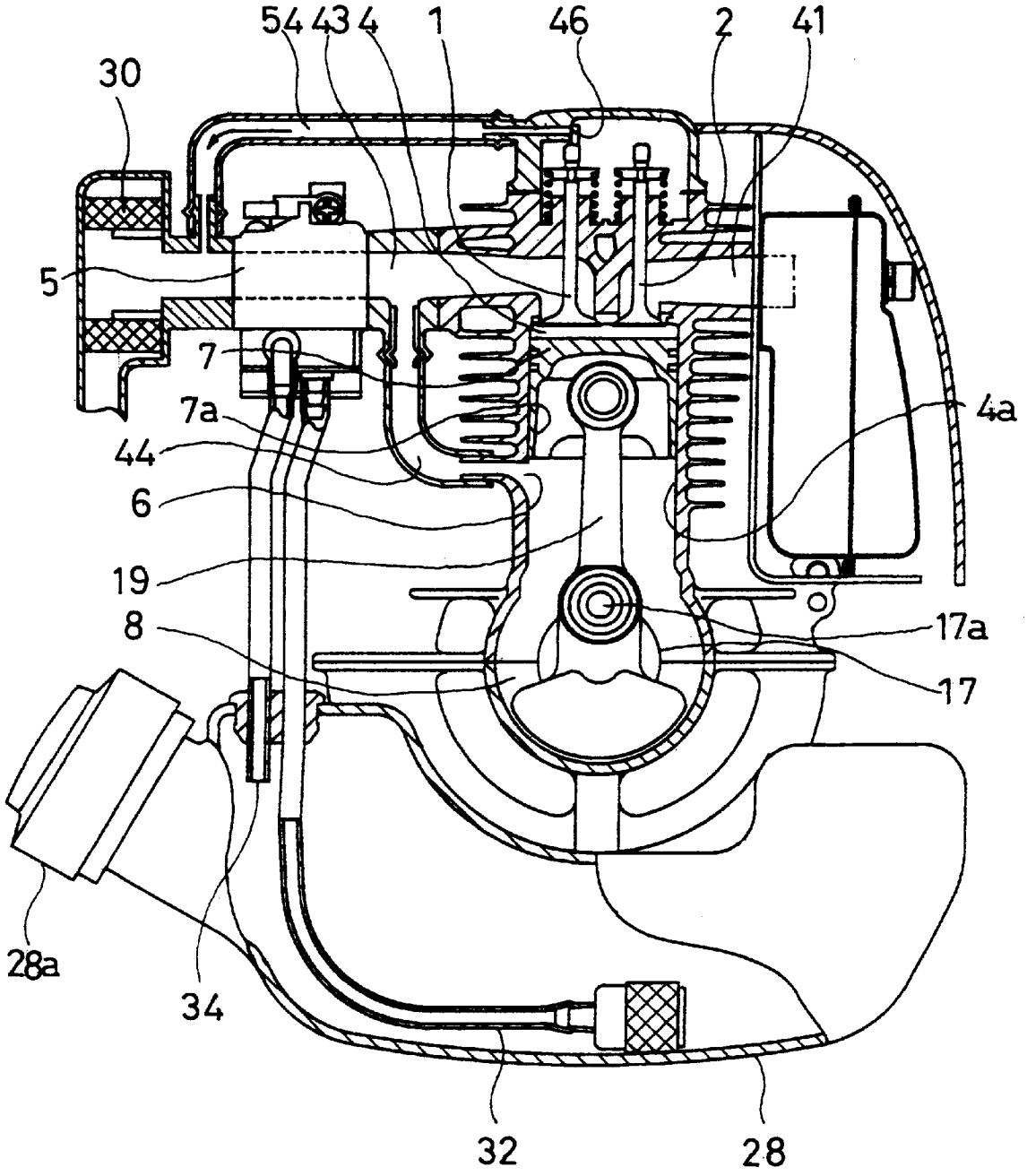
FIG. 8 is an explanatory view showing still another embodiment of the present invention in which a fifth passage is further provided between an air cleaner and a carburetor in the embodiments of FIGS. 6 and 7.

FIG. 8 shows an embodiment that provides a fifth passage 54 which allows the mixed gas composed of the lubricating oil, the fuel, and the air inhaled in the crank chamber, for flowing between an air cleaner 30 and the carburetor 5 via a switching valve 46 which is opened only in the case of opening the intake valve 1. By providing such a fifth passage 54, efficiency for inhaling the mixed gas inhaled into the cylinder in the case of opening the intake valve 1 can be enhanced.

Figure 9:
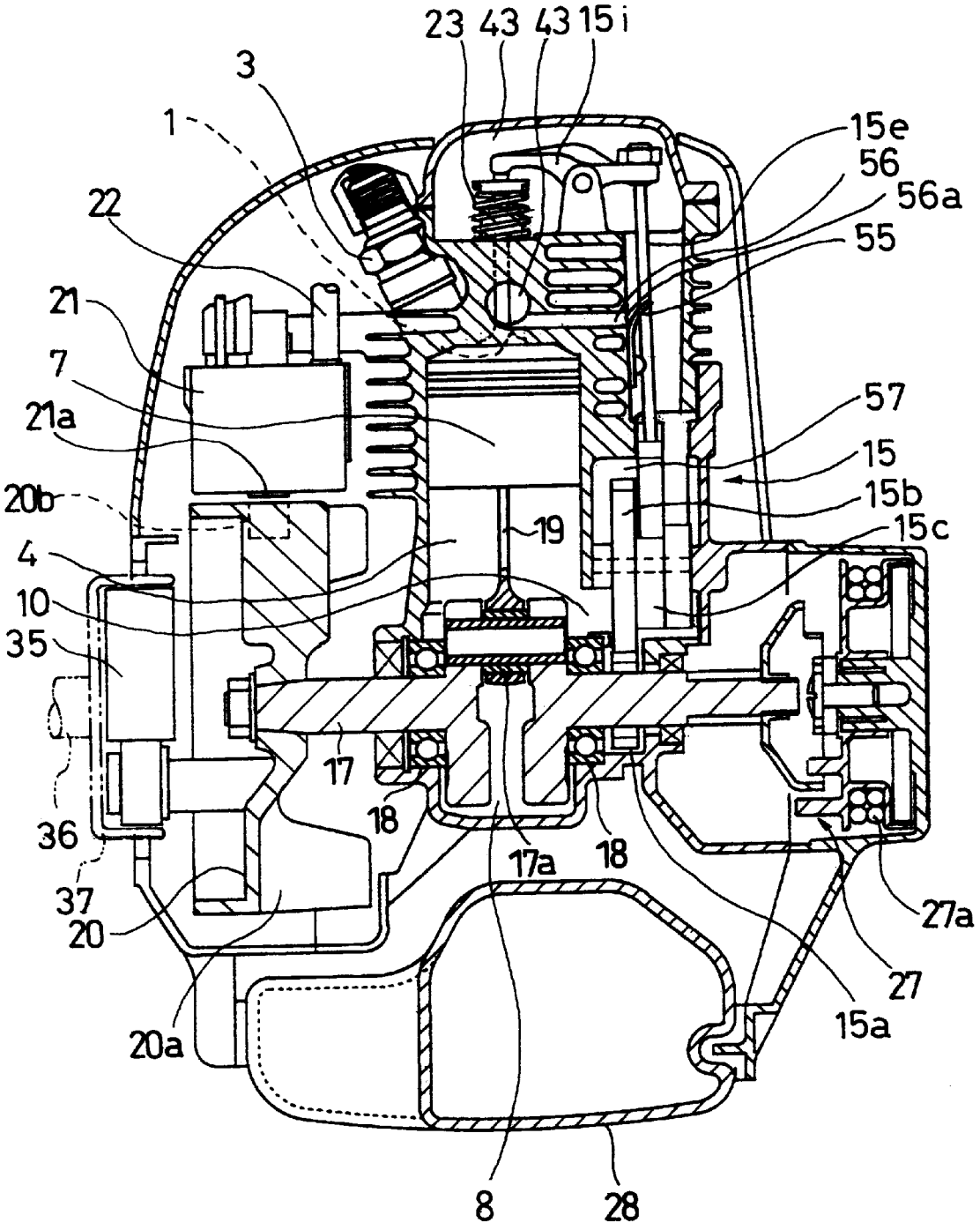
FIG. 9 is an explanatory view showing still another embodiment of the present invention in which a check valve is provided so that the mixed gas including the lubricating oil sufficiently flows into the valve gear mechanism.

FIG. 9 shows another embodiment. In this embodiment, a part of the mixed gas diverged from the first passage passes through a check valve 55 and is transferred into the valve gear mechanism 15. The mixed gas entering the passage including the valve gear mechanism is inhaled into the crank chamber in the stage of ascending the piston, and lubricates portions around the crankshaft within the crank chamber, the inner wall of the cylinder and the portions around the piston. In the stage of descending the piston, the mixed gas in the crank chamber is compressed to be transferred into the valve gear chamber via the outlet 10, and then enters the rocker arm chamber, while lubricating the valve gear chamber.

Figure 10:
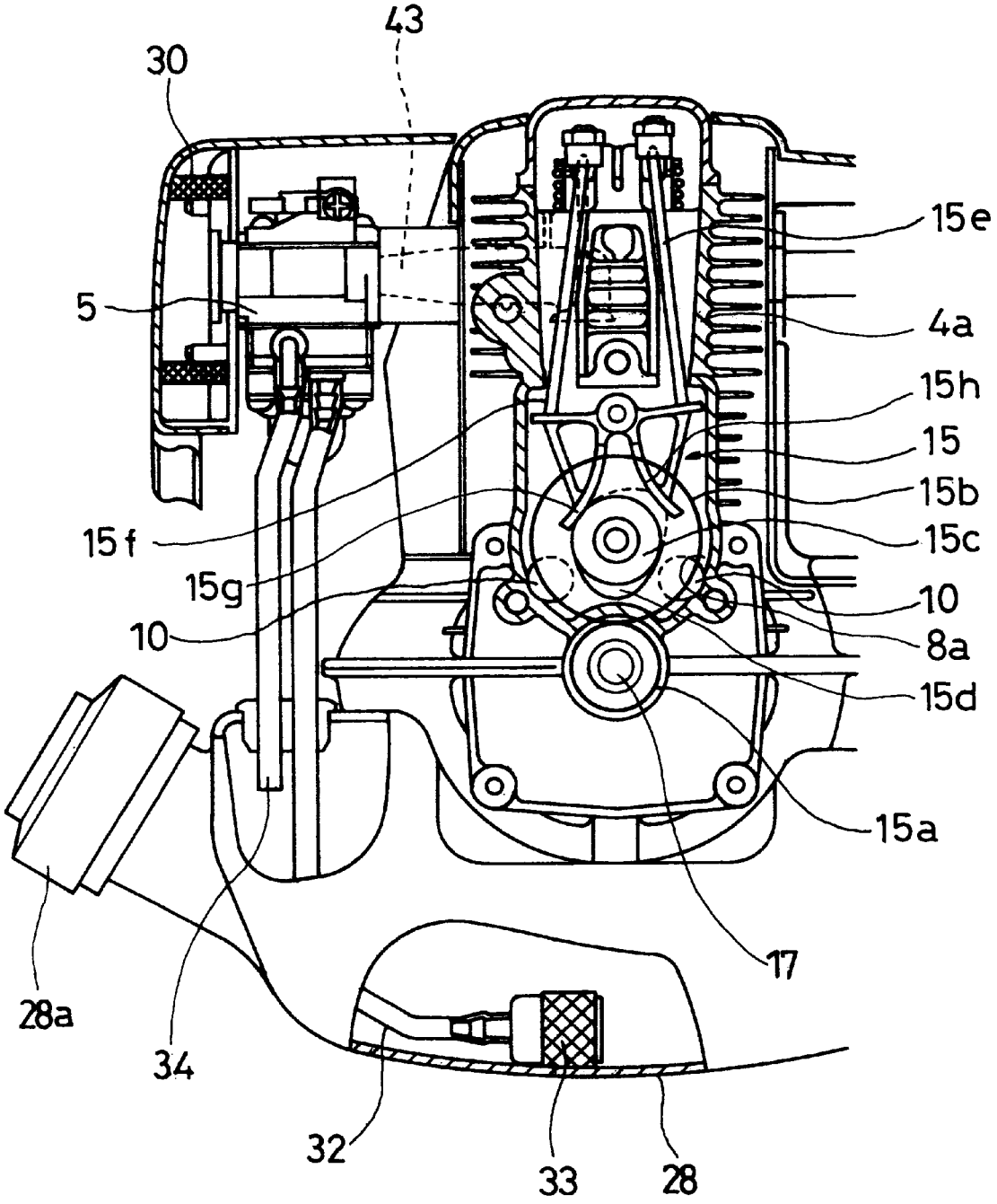
FIG. 10 is a side view showing the valve gear mechanism in the present invention.

FIG. 10 is an explanatory view showing the valve gear mechanism depicted on FIGS. 1 and 5. As shown in FIG. 1, a gear 15*a* which making up the valve gear mechanism for opening or closing the intake valve 1 shown in FIG. 2 and the exhaust valve 2 as shown in FIG. 2 is provided on a right side of the crankshaft 17. The reduction gear 15*b* engaged with the gear 15*a*. Cams 15*c* and 15*d*, which revolve together with the reduction gear 15*b*, are provided, and push rods 15*e* and 15*f* are connected to these cams 15*c* and 15*d*, respectively. Push rods 15*e* and 15*f* are provided so that they are operated by these cam lifters 15*g* and 15*h*. The cam lifters 15*g* and 15*f* are placed on the base ends of the push rods 15*e* and 15*f* (see FIGS. 1 and 5). To the front ends of the push rods 15*e* and 15*f* are connected to one ends of rocker arms 15*i* and 15*j* (see FIG. 4). The other ends of the rocker arms 15*i* and 15*j* are pushed down against springs 23 and 24 (see FIG. 4) to alternatively open the intake valve 1 and the exhaust valve 2. The parts making up the valve gear mechanism are provided in the mixed gas passage 9 so as to communicate the outlet 10 for the mixed gas perforated on the wall 8*a* of the crank chamber with the intake valve 1 through the outside of the cylinder wall 4*a*.

Figure 11A:
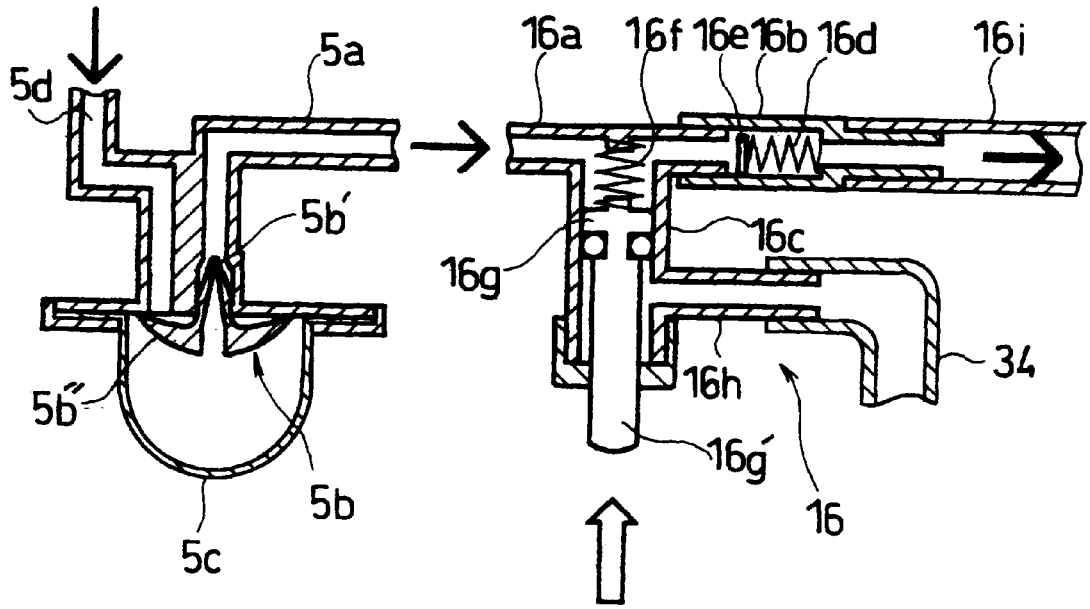
FIG. 11 is an explanatory view showing the movement of the manual pump in the present invention.
Figure 11B:
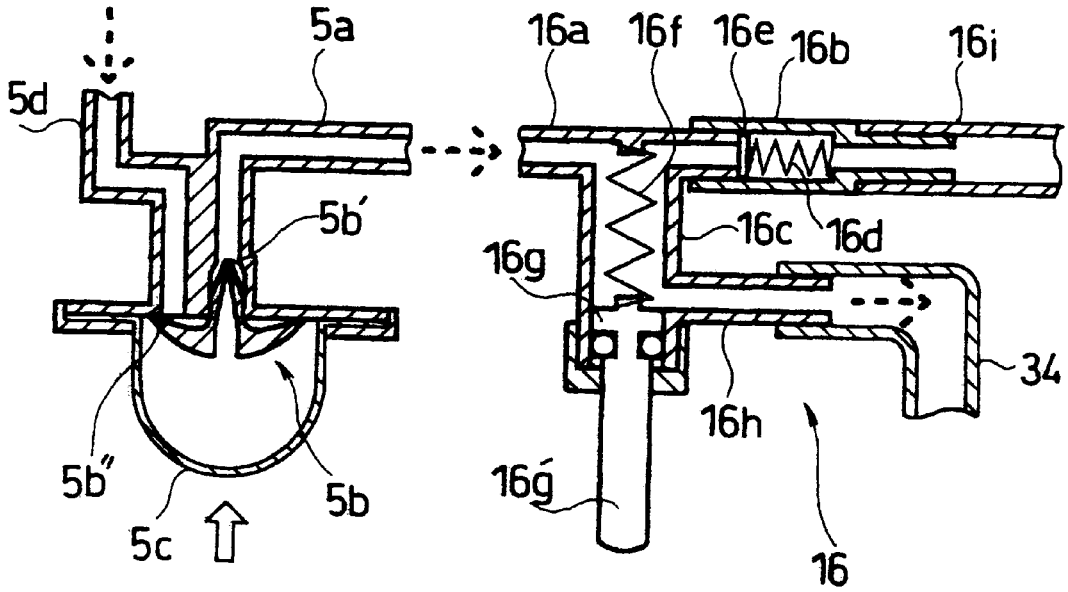

In FIG. 11, numerical 16 represents a manual pump for supplying a desired amount of the fuel to the intake valve 1 at starting the engine as described in the explanation of FIG. 2. As shown in FIG. 11A and FIG. 11B, in the manual pump 16, a fuel passage 16*a* is spilt into a fuel passage 16*b* communicating the intake valve and a pump cylinder 16*c*. Within the fuel passage 16*b*, a valve 16*e* in which the passage is closed by a spring 16*d* in a usual fuel pressure is provided, and within the pump cylinder 16*c* a piston 16*g* having a knob 16*g*' which is pushed back by a spring 16*f* is provided. When the piston 16*g* is pushed back, as shown in FIG. 11B, the mixed gas moves from the pump cylinder 16*c* to returning fuel passage 16*h* and is returned to the fuel tank 28 from an overflow pipe 34. When the piston 16*c* which has been pushed back as shown in FIG. 11A is pushed by a lever 5*e* (see FIG. 2), the piston 16*g* pushes the fuel in the pump cylinder 16*c*, the pushed fuel presses the valve 16*e* provided within the fuel passage 18*b* to the intake valve 1 to thereby open the valve 16*e*, whereby the fuel flows toward the intake valve 1 via the supply pipe 16*i*.

When the lever 5*e* (see FIG. 2) is pushed up, the actions described in FIG. 11A and 11B are conducted all at once. To be specific, the mixed gas composed of the fuel and air is returned to the fuel tank, and when the air contained in the mixed gas is removed, a part of the fuel in which air is removed from the mixed gas is transferred to the intake valve. By selecting the number of the lever pushed back, the fuel for the initial starting to be supplied to the intake can be controlled.

The manual pump has a construction that when the piston 16*g* is pushed, the fuel never flows back to the fuel pipe 5 at the side of the carburetor. In FIG. 11A and 11B, a check valve 5*b*' formed into a projection shape at the center of the bent face of the valve body 5*b* having a bent board structure made of a rubber or a flexible synthetic resin, is inserted into the base end. A fringing portion 5*b*" of the valve body 5*b* having a bent board structure is provided on the valve body 5*b* in such a manner that it blocks up the base end of the fuel passage 5*d*. The valve body 5*b* is covered with a rubber cap 5*c*. Consequently, as shown in FIG. 11A, even if the piston 16*g* is pushed up, the fuel never flows back from the fuel pipe 5*a* to the interior of the rubber cap 5*c* via the check valve 5*b*'.

As described above, the four-cycle engine according to the present invention has a construction comprising providing a new mixed gas passage which cause a mixed of a fuel and air and an appropriate amount of a lubricating oil to flow within a cylinder when a piston resides at portion near the top dead point, and compresses a gas containing the mixed gas and the lubricating oil within the crank chamber at the portion near the bottom dead point during the movement of the piston from the top dead point toward the bottom dead point to direct the gas toward the intake valve to compressively transfer the mixed gas containing the lubricating oil via the mixed gas passage, and providing a passage, thereby adhering the lubricating oil to the cylinder, piston, other, moving parts, and valve gear parts. By such a construction, there is no need for proving any oil pan, making it possible to provide a four-cycle engine having a simple structure, a light weight, an inexpensive manufacturing cost, having good lubricating mechanism, which can be run in any state of the inclination (360°).

Moreover, in the stage of descending the piston, the mixed gas in the crank chamber is compressed, and the mixed gas compressed in the stage just mentioned is transferred to the combustion chamber of the cylinder. This makes it possible to increase intake efficiency to thereby increase output of the engine.

Furthermore, by the construction that an inlet for the mixed gas composed of the fuel and air is perforated on the wall of the crank chamber so that the mixed gas is supplied from the carburetor not to the cylinder but to the crank chamber, a lead valve which is opened in the stage of ascending the piston and which is closed in the stage of descending the piston is provided on the mixed gas passage so that when the piston moves from the bottom dead point to the top dead point, the lead valve is closed such that the mixed gas is not flowing to the carburetor, the efficiency of the engine is further enhanced. As described above, it goes without saying that a lead valve is provided on the outlet 10 of the crank chamber to secure the intake and compressive transfer of the mixed gas.

The improvement in the efficiency of the engine may also be achieved if a rotary valve is provided in place of the lead valve.

It is, of course, possible that except for supplying the lubricating oil being mixed with a mixed gas composed of a fuel and air, the mixed gas composed of the fuel, air, and the lubricating oil is directly transferred to a rocker arm chamber, the mixed gas pass through the passage diverged at the bottom into the cylinder chamber or the crank chamber. It is of course possible to provide the check valve which return a part of the mixed gas reaching the rocker arm chamber via the crank chamber, and through the passage including the valve gear mechanism, to the crank chamber or to mix a part of the mixed gas reaching the rocker arm chamber with a fresh, mixed gas to improve the lubricating function, whereby the efficiency for inhaling the mixed gas can be improved.

While the necessary embodiments of the present invention including diverged passages and bypasses have been described, the scope of the present invention is not restricted thereto. It should be understood that various modification and variants of the passage may be selected as occasion may demand by those skilled in the art.

What is claimed is:

1. A four-cycle engine providing an intake valve, an exhaust valve, and an ignition plug on the top of a cylinder, and supplying a mixed gas composed of a fuel and air, said engine comprising:

an inlet for the mixed gas perforated on a cylinder wall so that a lubricating mixed gas composed of fuel and air and also previously containing a lubricating oil is supplied to the cylinder, said inlet being provided at a portion of the cylinder wall where said inlet is opened at a portion near the top dead point of the piston, and said inlet is closed by the piston in the ascending or descending stages other than the portion near the top dead point of the piston;

a passage for the lubricating mixed gas provided so that the lubricating mixed gas containing the lubricating oil, which is pushed to the crank chamber in the stage of descending the piston, is pushed out of an outlet of the lubricating mixed gas perforated on the crank chamber or cylinder wall, said lubricating mixed gas then passes through said passage including a valve gear mechanism provided outside of the crank chamber or the cylinder wall, and said lubricating mixed gas is transferred to the intake valve placed at the top of the cylinder; and a lead valve provided between the inlet of the lubricating mixed gas and the outlet of the passage communicating with the carburetor so that the lubricating mixed gas never flows back to a carburetor side of said engine, wherein said valve gear mechanism drive a movement of said intake and exhaust valves.

2. The four-cycle engine as set forth in claim 1, wherein a supply pump is provided so that a desired amount of the lubricating oil is supplied to the passage communicating the carburetor with the inlet perforated on the cylinder wall or on the crank chamber.

3. The four-cycle engine as set forth in claim 1, wherein a manual pump for supplying a desired amount of the fuel to the intake valve at the start of the engine is provided.

4. The four-cycle engine as set forth in claim 1, wherein said valve gear mechanism comprises at least one reduction gear.

5. The four-cycle engine as set forth in claim 1, wherein said valve gear mechanism comprises at least one push rod.

6. The four-cycle engine as set forth in claim 1, wherein said valve gear mechanism comprises at least one cam lifter.

* * * * *